US009041290B2

(12) United States Patent
Preston

(10) Patent No.: US 9,041,290 B2
(45) Date of Patent: May 26, 2015

(54) PLASMA LIGHT SOURCE

(75) Inventor: Barry Preston, Melton Mowbray (GB)

(73) Assignee: Ceravision Limited

( * ) Notice: Subject to any disclaimer, the term of this patent is extended or adjusted under 35 U.S.C. 154(b) by 208 days.

(21) Appl. No.: 13/808,586

(22) PCT Filed: Jul. 12, 2011

(86) PCT No.: PCT/GB2011/001047
§ 371 (c)(1),
(2), (4) Date: Mar. 13, 2013

(87) PCT Pub. No.: WO2012/007712
PCT Pub. Date: Jan. 19, 2012

(65) Prior Publication Data

US 2013/0214679 A1 Aug. 22, 2013

(30) Foreign Application Priority Data

Jul. 13, 2010 (GB) ..... 1011786.9

(51) Int. Cl.
*H05H 1/46* (2006.01)
*H01J 65/04* (2006.01)

(52) U.S. Cl.
CPC ..... *H05H 1/46* (2013.01); *H01J 65/044* (2013.01)

(58) Field of Classification Search
CPC ..... H01J 65/044; H05H 1/46
USPC ..... 315/34, 39; 362/257, 263, 265
See application file for complete search history.

(56) References Cited

U.S. PATENT DOCUMENTS

| | | | | |
|---|---|---|---|---|
| 4,792,725 | A | 12/1988 | Levy | |
| 5,028,847 | A | 7/1991 | Greb | |
| 8,164,264 | B2 * | 4/2012 | Neate et al. | 315/39 |
| 2010/0194257 | A1 * | 8/2010 | Neate | 313/114 |

* cited by examiner

*Primary Examiner* — Douglas W Owens
*Assistant Examiner* — Pedro C Fernandez
(74) *Attorney, Agent, or Firm* — Jennifer Meredith, Esq.; Meredith & Keyhani, PLLC

(57) ABSTRACT

A High Frequency light source has a central body of fused quartz, with a central void, filled with a fill in the void of material excitable by High Frequency energy to form a light emitting plasma. An inner sleeve of perforate metal shim extends along the length of the central body to provide a launching gap. The sleeve has a transverse end portion extending across the other, inner end of the central body. An outer cylinder of fused quartz with an internal bore such as to be a sliding fit with the inner sleeve, itself a sliding fit on the central body. An outer sleeve of perforate metal, enclosing the outer cylinder and having an end portion extending across the flush, void ends of the quartz body and cylinder and having a skirt extending past the flush over an aluminum carrier, clamped and holding the quartz elements against the carrier.

16 Claims, 2 Drawing Sheets

PLASMA LIGHT SOURCE

CROSS-REFERENCE TO RELATED APPLICATIONS

This application is a national stage under 35 U.S.C. 371 of International Application No. PCT/GB2011/001047 filed Jul. 12, 2011 which claims priority to and the benefit of United Kingdom patent application number 1011786.9 filed Jul. 13, 2010.

BACKGROUND OF THE INVENTION

The present invention relates to a plasma light source.

High Frequency (HF) Plasma is a term often applied to mean both Radio Frequency, RF 1-300 MHz) and Microwave 0.3-300 GHz) excited plasmas. Most HF Plasmas used as light sources are fully localised inside the HF field applicator, that is the discharges are sustained in capacitive or inductive circuits and in resonant cavities, coaxial lines and waveguides.

A drawback of an air filled resonant cavity device is that the size of the cavity is determined by the frequency of operation. Technically successful cavity systems have been designed for operation at 2.4 GHz. At suitable frequencies (ISM Industrial, Scientific and Medical-bands) below this frequency the size of the cavity and the associated waveguides is liable to become physically too large for use in commercial lighting systems. It also becomes difficult to design high pressure plasma chambers for such cavities which operate plasmas at combinations of high radiation efficiency and usefully low power, i.e. less than 400 watts, required for most commercial applications. Indeed even at 2.45 GHz obtaining system powers of less than 400 watts with plasmas of the required radiation efficiency can be difficult.

In order to provide plasmas with a high radiation efficiency and operation at powers less than 400 watts it is known to operate plasma chambers within a dielectric filled resonant cavity. While this latter configuration is suitable as a light source for applications such as projection where small source size is the primary benefit being sought, the first configurations had serious limitations for general lighting situations because of the obstruction of a high percentage of light from the source by the opaque dielectric structure. In this configuration less than 50% of the surface area of a bulb is able to emit light into a limited solid angle, $27\pi$ steradian, of free space. This surface area is usually maximised by designing a portion of the bulb volume to be external to the cavity.

As shown in our International Application No PCT/GB2008/003829, we have overcome this drawback. In that application, we describe a light source to be powered by microwave energy, the source having:

- a body having a sealed void therein,
- a microwave-enclosing Faraday cage surrounding the body,
- the body within the Faraday cage being a resonant waveguide,
- a fill in the void of material excitable by microwave energy to form a light emitting plasma therein, and
- an antenna arranged within the body for transmitting plasma-inducing, microwave energy to the fill, the antenna having:
  - a connection extending outside the body for coupling to a source of microwave energy;

wherein:

- the body is a solid plasma crucible of material which is lucent for exit of light therefrom, and

- the Faraday cage is at least partially light transmitting for light exit from the plasma crucible, the arrangement being such that light from a plasma in the void can pass through the plasma crucible and radiate from it via the cage.

As used in that application:

- "lucent" means that the material, of which an item described as lucent is comprised, is transparent or translucent;
- "plasma crucible" means a closed body enclosing a plasma, the latter being in the void when the void's fill is excited by microwave energy from the antenna;
- "Faraday cage" means an electrically conductive enclosure of electromagnetic radiation, which is at least substantially impermeable to electromagnetic waves at the operating, i.e. microwave, frequencies.

In this application we use "Faraday cage" in analogous manner, but not restricted to enclosing microwaves but extended to enclosing the electromagnetic waves at the operating frequency whatever that may be in the HF band as defined above. We do not use the term "plasma crucible" in this application.

Plasmas can be created by travelling waves in waveguides and slow wave structures, so called Travelling Wave Discharges (TWD). For lighting purposes one member of this class of discharges, the Surface Wave Discharge (SWD), has in the past been widely assessed as being particularly promising; this is the propagative Surface Wave Discharge SWD. This type of discharge is well known in the literature, electromagnetic energy forms the plasma and the plasma itself is the structure along which the wave is propagated. A practical field applicator for a SWD is a surfatron. Surfatrons are wide band structures that may be used over a frequency range of 200 MHz to 2.45 GHz and have the property that very high energy coupling efficiencies can be achieved. Greater than 90% of the HF energy can be coupled into the plasma. Although SWD's launched by surfatrons have been proposed for lighting applications, these have been aimed at low pressure discharges. The major application for SWD's is large volume sub-atmospheric to atmospheric pressure plasmas for various processes in microcircuit fabrication. For high pressure lighting applications there is a drawback. The volume of the plasma is very dependant on the plasma pressure and plasma power. At powers of less than 400 watts and pressures of a few atmospheres the vast bulk of the plasma is contained within the launching structure, so that given the opaque nature of the known surfatron devices very little of the light produced by the plasma can be harvested.

A typical surfatron structure is shown in diagrammatically in FIG. 1. The surfatron 1 has an HF structure consisting of two metal cylinders 2,3 forming a section of coaxial transmission line 4 terminated by a short circuit 5 at one end and by a circular gap 6 at the other. A HF electric field extending through the gap can excite an azimuthally symmetric surface wave to sustain a plasma column 7 of excitable material in a dielectric tube 8 arranged co-axially within the cylinders. A coaxial, cylindrical, capacitative coupler 9 is positioned between the cylinders, with a connection 10 extending out through outer cylinder. There it is connected to an input transmission line. A plate is attached to the inner conductor to form a capacitance between this plate and the inner metal cylinder.

BRIEF SUMMARY OF THE INVENTION

The object of the present invention is to provide an improved light source.

BRIEF DESCRIPTION OF SEVERAL VIEW OF THE DRAWINGS

DETAILED DESCRIPTION OF THE INVENTION

Figure 1:
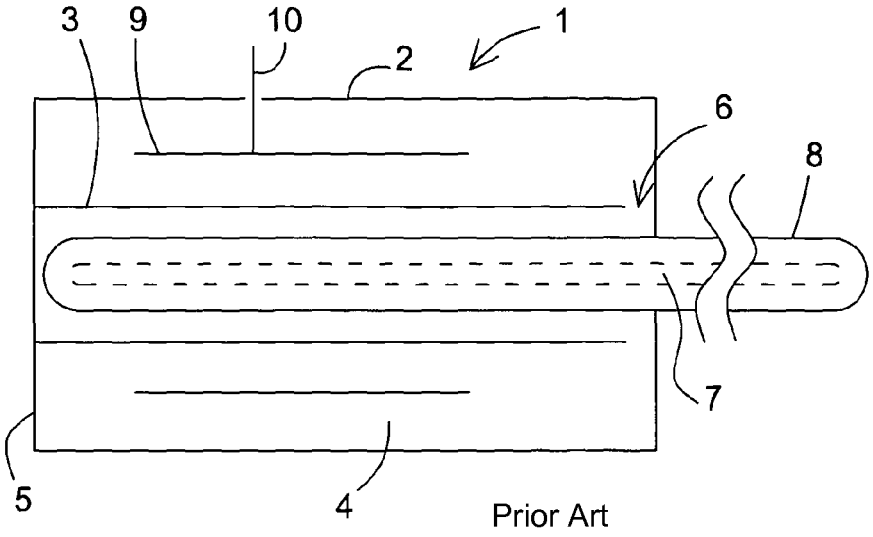
FIG. 1 is a diagrammatic cross-sectional side view of a known surfatron.

According to the invention there is provided a light source to be powered by High Frequency energy, the source having:

- an enclosure of lucent material, the enclosure having:
  - a sealed void therein,
- a fill in the void of material excitable by High Frequency energy to form a light emitting plasma therein,
- a High Frequency energy-enclosing Faraday cage surrounding the enclosure, the Faraday cage being:
  - at least partially light transmissive for light exit from the plasma crucible and the Faraday cage having:
  - two end portions and an outer sleeve between the end portions, and
- an antenna arranged within the Faraday cage for transmitting plasma-inducing, High Frequency energy to the fill, the antenna having:
- a connection extending outside the Faraday cage for coupling to a source of High Frequency energy; wherein:
- a High Frequency energy-barrier cylindrical inner sleeve is arranged within the outer sleeve, the inner sleeve being:
  - at least partially light-transmissive for light passage therethrough and being,
  - connected electrically at one end to one end portion of the Faraday cage and
  - defining a launching gap at the other end with the other end portion of the Faraday cage,
- the enclosure is arranged within the inner sleeve and
  - the antenna is arranged between the inner and the outer sleeves; whereby High Frequency energy introduced between the sleeves via the antenna can be launched via the gap into the inner sleeve for excitation of the plasma and radiation of light through the sleeves and out of the source.

Whilst it can be envisaged that the space between the sleeves could be empty of solid material; preferably the space between the sleeves is at least partially filled with lucent, solid dielectric material. In the preferred embodiment, the space is substantially filled with quartz.

Further, it can be envisaged that the inner sleeve is of greater cross-section than the void enclosure, the intervening space being empty of solid material. However, the intervening space is preferably filled with lucent, solid dielectric material. A number of configurations are possible:

- the inner sleeve being of greater cross-section than the void enclosure, the intervening space being filled with lucent, solid dielectric material;
- the void enclosure being a bulb containing the fill, the bulb being housed in a bore in a lucent, solid dielectric material body within the inner sleeve. Preferably the bulb fills the bore in the body and is fused thereto. Alternatively, the bulb is radially spaced from the bore in the body and is fused thereto;
- the inner sleeve being of substantially the same cross-section as the void enclosure, the void being a bore in the enclosure, sealed at both ends thereof.

Preferably, the void is at the launching gap end of the inner sleeve.

In the preferred embodiment:

- the lucent, solid dielectric material within the inner sleeve and between the sleeves are separated by the thickness of the inner sleeve only at the launching gap;
- the inner and the outer sleeves are reticular and metallic; and
- the outer sleeve has an imperforate rim via which the light source is clamped to a metallic carrier providing one end portion of the Faraday cage.

Figure 2:
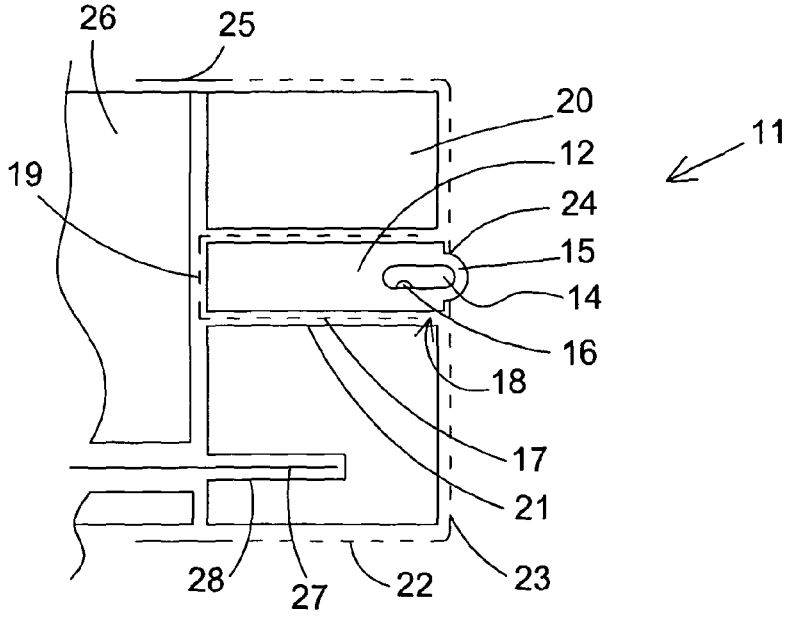
FIG. 2 is a diagrammatic cross-sectional side view of a light source in accordance with the invention.
Figure 3:
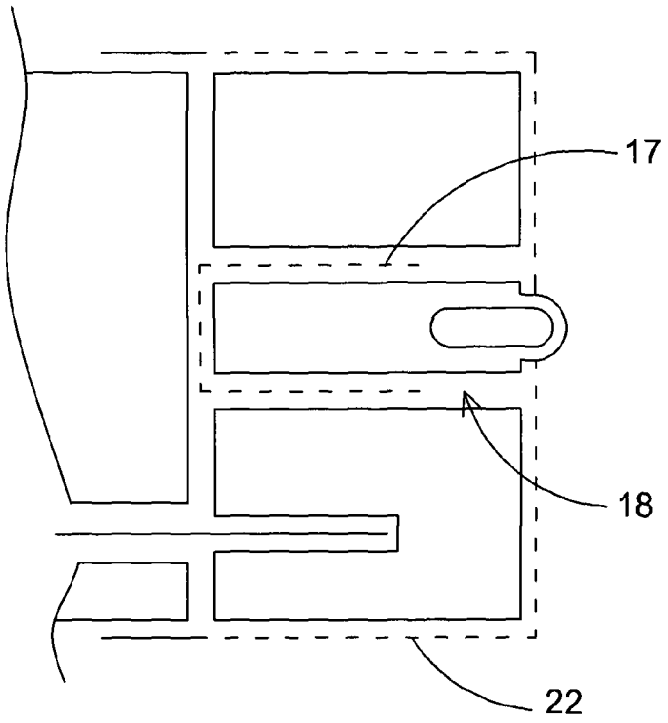
FIG. 3 is a view similar to FIG. 2 of a variant of the light source of FIG. 2.

To help understanding of the invention, a specific embodiment thereof will now be described by way of example and with reference to the accompanying drawings, in which:

FIG. 1 is a diagrammatic cross-sectional side view of a known surfatron;

FIG. 2 is a diagrammatic cross-sectional side view of a light source in accordance with the invention; and FIG. 3 is a view similar to FIG. 2 of a variant of the light source of FIG. 2.

Referring to FIG. 2, there is shown diagrammatically a light source 11 to be powered by High Frequency energy, in particular 433 MHz energy. It comprises:

- a central body 12 of fused quartz, the body being circularly cylindrical, 32 mm long and 16 mm in diameter;
- a void 14 in the central body, the void being formed as a 4 mm bore in the body, 10 mm long and sealed via the vestige 15 of a tube fused to the body and through which the void was evacuated and filled;
- a fill 16 in the void of material excitable by High Frequency energy to form a light emitting plasma therein, typical the fill is of metal halide material in an inert gas atmosphere;
- an inner sleeve 17 of perforate metal shim extending along the length of the central body to within 2.5 mm of its void end to provide a launching gap 18. The sleeve has a transverse end portion 19 extending across the other, inner end of the central body;
- an outer cylinder of fused quartz 20, also 32 mm in length, with an internal bore 21 such as to be a sliding fit with the inner sleeve, itself a sliding fit on the central body. The result is a thin gap between the two quartz elements 12,20 at the launching gap, which is negligible in electromagnetic terms. The outer cylinder is 81 mm in outside diameter;
- an outer sleeve 22 of perforate metal, enclosing the outer cylinder and having an end portion 23 extending across the flush, void ends of the quartz body and cylinder 12,20, with an aperture 24 for the tube vestige 15. The outer sleeve has a skirt 25 extending past the flush other ends of the quartz elements over an aluminium carrier 26, where it is clamped, by known shown means, holding the quartz elements against the carrier. Thus the sleeve forms, with its end 22 and the carrier 26, a Faraday cage around the quartz and the plasma void 14;
- an antenna 27 insulated from and extending from the carrier into a bore 28 in the quartz cylinder 20 for introducing HF radiation into the coaxial wave guide formed by the perforate inner and outer sleeves 17,21. Their perforation is such as
  - to make them opaque and enclosing to the HF radiation yet light transmissive, whereby light from the plasma can pass through them. The portion of the antenna in the carrier provides a connection to a non-shown source of HF energy.

The inner sleeve 17, at its end portion 19, is earthed to the carrier, in the same way as the outer sleeve and its end portion

23. Thus the gap 18 between the end of the inner sleeve and the end portion of the Faraday cage forms a launching gap for the HF energy to radiate to the plasma void and establish and maintain the plasma therein. Light from the plasma passes through the quartz and through the perforations in the sleeves and the end portion 19, and thus out of the light source.

In the variant of FIG. 3, the inner sleeve 17 is shorter and the launching gap is wider, typically 10 mm, such that the bulk of the light passes out of the source via the outer sleeve 22 only of the Faraday cage.

The invention claimed is:

1. A light source powered by High Frequency energy, the source having:

an enclosure of lucent material, the enclosure having:

a sealed void therein, a fill in the void of material excitable by High Frequency energy to form a light emitting plasma therein, a High Frequency energy-enclosing Faraday cage surrounding the enclosure, the Faraday cage being:

at least partially light transmissive for light exit from the plasma crucible and the Faraday cage having:

two end portions and an outer sleeve between the end portions, and an antenna arranged within the Faraday cage for transmitting plasma-inducing, High Frequency energy to the fill, the antenna having:

a connection extending outside the Faraday cage for coupling to a source of High Frequency energy;

wherein:

a High Frequency energy-barrier cylindrical inner sleeve is arranged within the outer sleeve, the inner sleeve being:

at least partially light-transmissive for light passage therethrough and being, connected electrically at one end to one end portion of the Faraday cage and defining a launching gap at the other end with the other end portion of the Faraday cage, the enclosure is arranged within at least one of the inner sleeve and the launching gap and the antenna is arranged between the inner and the outer sleeves; whereby High Frequency energy introduced between the sleeves via the antenna can be launched via the gap into the inner sleeve for excitation of the plasma and radiation of light through the sleeves and out of the source.

2. A light source as claimed in claim 1, wherein the space between the sleeves is empty of solid material, except that of the void enclosure.

3. A light source as claimed in claim 1, wherein the space between the sleeves is at least partially filled with lucent, solid dielectric material.

4. A light source as claimed in claim 1, wherein the inner sleeve is of greater cross-section than the void enclosure, the intervening space being empty of solid material.

5. A light source as claimed in claim 1, wherein the inner sleeve is of greater cross-section than the void enclosure, the intervening space being filled with lucent, solid dielectric material.

6. A light source as claimed in claim 5, wherein the void enclosure is a bulb containing the fill, the bulb being housed in a bore in a lucent, solid dielectric material body within the inner sleeve.

7. A light source as claimed in claim 6, wherein the bulb fills the bore in the body and is fused thereto.

8. A light source as claimed in claim 6, wherein the bulb is radially spaced from the bore in the body and is fused thereto.

9. A light source as claimed in claim 1, wherein the inner sleeve is of substantially the same cross-section as the void enclosure, the void being a bore in the enclosure, sealed at both ends thereof.

10. A light source as claimed in claim 1, wherein the void is at the launching gap end of the inner sleeve.

11. A light source as claimed in claim 5, wherein:

the space between the sleeves is at least partially filled with lucent, solid dielectric material and the lucent, solid dielectric material within the inner sleeve and between the sleeves are separately by the thickness of the inner sleeve only at the launching gap.

12. A light source as claimed in claim 5, wherein the lucent, solid dielectric material is fused quartz.

13. A light source as claimed in claim 1, the inner and the outer sleeves are reticular and metallic.

14. A light source as claimed in claim 13, wherein the outer sleeve has an imperforate rim via which the light source is clamped to a metallic carrier providing one end portion of the Faraday cage.

15. A light source as claimed in claim 1, wherein the void is arranged axially of the light source at least partially overlapping with the inner sleeve.

16. A light source as claimed in claim 1, wherein the void is arranged axially of the light source so as not to over-lap with the inner sleeve.

* * * * *